US012371824B2

(12) United States Patent
Dufty et al.

(10) Patent No.: US 12,371,824 B2
(45) Date of Patent: Jul. 29, 2025

(54) FLAME RESISTANT FABRICS FORMED WITH STRETCHABLE YARNS

(71) Applicant: Southern Mills, Inc., Union City, GA (US)

(72) Inventors: Elijah Dufty, Atlanta, GA (US); Robert Self, Peachtree City, GA (US); Michael A. Laton, Peachtree City, GA (US); Kevin Hilton, Zebulon, GA (US)

(73) Assignee: Southern Mills, Inc., Union City, GA (US)

( * ) Notice: Subject to any disclaimer, the term of this patent is extended or adjusted under 35 U.S.C. 154(b) by 133 days.

(21) Appl. No.: 17/749,670

(22) Filed: May 20, 2022

(65) Prior Publication Data

US 2022/0372671 A1 Nov. 24, 2022

Related U.S. Application Data

(60) Provisional application No. 63/191,485, filed on May 21, 2021.

(51) Int. Cl.

| | |
|---|---|
| ***D02G 3/44*** | (2006.01) |
| ***D02G 3/04*** | (2006.01) |
| ***D02G 3/32*** | (2006.01) |
| ***D03D 15/513*** | (2021.01) |

(52) U.S. Cl.

CPC ..... *D02G 3/443* (2013.01); *D02G 3/047* (2013.01); *D02G 3/32* (2013.01); *D03D 15/513* (2021.01); *D10B 2201/22* (2013.01); *D10B 2321/101* (2013.01); *D10B 2331/021* (2013.01); *D10B 2401/062* (2013.01); *D10B 2501/04* (2013.01)

(58) Field of Classification Search

None

See application file for complete search history.

(56) References Cited

U.S. PATENT DOCUMENTS

| | | | |
|---|---|---|---|
| 5,069,957 | A | 12/1991 | Vandermeersch |
| 5,098,756 | A | 3/1992 | Henderson et al. |
| 5,448,779 | A | 9/1995 | Aldridge |
| 5,527,597 | A | 6/1996 | Stanhope et al. |
| 5,694,981 | A | 12/1997 | Stanhope et al. |
| 6,782,590 | B2 | 8/2004 | Rock et al. |
| 6,828,003 | B2 | 12/2004 | Rock et al. |
| 6,889,494 | B2 | 5/2005 | Tanahashi et al. |
| 7,043,766 | B1 | 5/2006 | Foreman et al. |
| RE40,314 | E | 5/2008 | Rock et al. |
| RE41,574 | E | 8/2010 | Rock et al. |
| 7,776,421 | B2 | 8/2010 | Rock et al. |
| 8,298,645 | B2 | 10/2012 | Rock et al. |
| 8,484,940 | B2 | 7/2013 | Bruner |
| 8,932,966 | B2 | 1/2015 | Rock et al. |
| 9,038,203 | B2 | 5/2015 | Curtis |
| 9,138,019 | B2 | 9/2015 | Curtis |
| 9,234,304 | B2 | 1/2016 | Bruner |
| 9,457,205 | B2 | 10/2016 | John et al. |
| 9,580,843 | B2 | 2/2017 | Okuya et al. |
| 9,642,471 | B2 | 5/2017 | Curós Santaeularia et al. |
| 9,706,804 | B1 | 7/2017 | Emery et al. |
| 9,745,674 | B2 | 8/2017 | Hines et al. |
| 9,765,454 | B2 | 9/2017 | Tutterow et al. |
| 10,030,326 | B2 | 7/2018 | Hines, Jr. et al. |
| 10,183,465 | B1 | 1/2019 | Bowman et al. |
| 10,316,440 | B2 | 6/2019 | Stanhope et al. |
| 10,433,593 | B1 | 10/2019 | Dilanni et al. |
| 10,441,013 | B1 | 10/2019 | Emery et al. |
| 10,563,328 | B2 | 2/2020 | Martin et al. |
| 10,617,225 | B1 | 4/2020 | Wildeman |
| 10,774,451 | B2 | 9/2020 | Stanhope et al. |
| 2002/0088501 | A1 | 7/2002 | Bruner |
| 2003/0005997 | A1 | 1/2003 | Bruner |
| 2005/0042412 | A1 | 2/2005 | Bruner |
| 2006/0000005 | A1 | 1/2006 | Foreman et al. |
| 2006/0105658 | A1 | 5/2006 | Patz et al. |
| 2006/0113033 | A1 | 6/2006 | Bruner |
| 2008/0057807 | A1 | 3/2008 | Tutterow et al. |
| 2008/0076312 | A1 | 3/2008 | Gehring |
| 2008/0152888 | A1 | 6/2008 | Tutterow et al. |
| 2008/0289090 | A1 | 11/2008 | Brier |
| 2009/0049579 | A1 | 2/2009 | Roberts |
| 2009/0298370 | A1 | 12/2009 | Rock |
| 2010/0009586 | A1 | 1/2010 | Verdu et al. |
| 2010/0112312 | A1 | 5/2010 | Tutterow et al. |
| 2011/0120588 | A1 | 5/2011 | Shteiyer |
| 2012/0102657 | A1 | 5/2012 | Wildeman |
| 2012/0255128 | A1 | 10/2012 | Sytz |
| 2013/0065470 | A1 | 3/2013 | Rock et al. |
| 2013/0101781 | A1 | 4/2013 | Lee et al. |
| 2015/0361599 | A1 | 12/2015 | Minor |
| 2016/0059050 | A1 | 3/2016 | Gomez |
| 2016/0060809 | A1 | 3/2016 | Hines et al. |
| 2016/0249685 | A1 | 9/2016 | Blasi |
| 2017/0143045 | A1 | 5/2017 | Audet et al. |
| 2017/0167058 | A1 | 6/2017 | Tutterow et al. |
| 2017/0295874 | A1 | 10/2017 | Vanetti |
| 2018/0002840 | A1 | 1/2018 | Tutterow et al. |

(Continued)

FOREIGN PATENT DOCUMENTS

| | | |
|---|---|---|
| GB | 2575094 A | 1/2020 |
| WO | 1999/042644 | 8/1999 |

(Continued)

OTHER PUBLICATIONS

PCT Patent Application No. PCT/US2022/030273, International Search Report and Written Opinion, Sep. 5, 2022, 12 pages.

*Primary Examiner* — Arti Singh-Pandey

(74) *Attorney, Agent, or Firm* — Kilpatrick Townsend & Stockton LLP

(57) ABSTRACT

Flame resistant fabrics formed with a combination of body yarns and stretch yarns that exhibit excellent physical and thermal properties. The body yarns are formed at least in part with flame resistant materials. The stretch yarns are core-spun yarns having an elastic core surrounded by a fiber sheath formed at least in part with flame resistant materials. The fiber sheath protects the elastic core from direct exposure to heat and flame that would otherwise cause the core to degrade or melt.

20 Claims, No Drawings

(56) References Cited

U.S. PATENT DOCUMENTS

| | | | |
|---|---|---|---|
| 2018/0127899 | A1 | 5/2018 | Tutterow et al. |
| 2018/0127917 | A1 | 5/2018 | Hines et al. |
| 2018/0171516 | A1 | 6/2018 | Stanhope et al. |
| 2019/0233988 | A1 | 8/2019 | Harada et al. |
| 2020/0165756 | A1 | 5/2020 | Martin et al. |
| 2020/0308735 | A1 | 10/2020 | Adams et al. |

FOREIGN PATENT DOCUMENTS

| | | |
|---|---|---|
| WO | 2001/046503 | 6/2001 |
| WO | 2006/030628 | 3/2006 |
| WO | 2008/027454 | 3/2008 |
| WO | 2008/048256 | 4/2008 |
| WO | 2008/097356 | 8/2008 |
| WO | 2009/012266 | 1/2009 |
| WO | 2011/007018 | 1/2011 |
| WO | 2011/150902 | 12/2011 |
| WO | 2012/048073 | 4/2012 |
| WO | 2013/106533 | 7/2013 |
| WO | 2014/018221 | 1/2014 |
| WO | 2014/025601 | 2/2014 |
| WO | 2014/199969 | 12/2014 |
| WO | 2015/027445 | 3/2015 |
| WO | 2015/081312 | 6/2015 |
| WO | 2015/195598 | 12/2015 |
| WO | 2016/010659 | 1/2016 |
| WO | 2016/042556 | 3/2016 |
| WO | 2016/135562 | 9/2016 |
| WO | 2017/084061 | 5/2017 |
| WO | 2018/053990 | 3/2018 |
| WO | 2018/066439 | 4/2018 |
| WO | 2019/004494 | 1/2019 |
| WO | 2020/002873 | 1/2020 |
| WO | 2020/034957 | 2/2020 |
| WO | 2020/214772 | 10/2020 |

FLAME RESISTANT FABRICS FORMED WITH STRETCHABLE YARNS

CROSS-REFERENCE TO RELATED APPLICATIONS

This application claims the benefit of U.S. Provisional Application No. 63/191,485, entitled "Flame Resistant Fabrics Formed with Stretchable Yarns," filed on May 21, 2021, the entire contents of which are hereby incorporated by reference.

FIELD

Embodiments of the present invention relate to flame resistant fabrics formed at least in part with stretchable yarns formed of an elastic material.

BACKGROUND

Protective garments are designed to protect the wearer from hazardous environmental conditions the wearer might encounter. Such garments include those designed to be worn by firefighters and other rescue personnel, industrial and electrical workers, and military personnel. Such occupations can potentially expose an individual to electrical arc flash and/or flames. Workers who may be exposed to accidental electric arc flash and/or flames risk serious burn injury unless they are properly protected. To avoid being injured while working in such conditions, these individuals typically wear protective garments constructed of flame resistant materials designed to protect them from electrical arc flash and/or flames. Such protective clothing can include various garments, for example, coveralls, pants, and shirts.

Standards have been promulgated that govern the performance of such garments (or constituent layers or parts of such garments) to ensure that the garments sufficiently protect the wearer in hazardous situations.

ASTM F1506 (*Standard Performance Specification for Flame Resistant and Arc Rated Textile Materials for Wearing Apparel for Use by Electrical Workers Exposed to Momentary Electric Arc and Related Thermal Hazards,* 2022 edition, incorporated herein by reference) requires arc rating testing of protective fabrics worn by electrical workers. The arc rating value represents a fabric's performance when exposed to an electrical arc discharge. The arc rating is expressed in cal/cm$^2$ (calories per square centimeter) and is derived from the determined value of the arc thermal performance value (ATPV) or Energy Breakopen threshold ($E_{BT}$). ATPV is defined as the arc incident energy on a material that results in a 50% probability that sufficient heat transfer through the specimen is predicted to cause the onset of second-degree burn injury based on the Stoll Curve. $E_{BT}$ is the arc incident energy on a material that results in a 50% probability of breakopen. Breakopen is defined as any open area in the material at least 1.6 cm$^2$ (0.5 in$^2$). The arc rating of a material is reported as either ATPV or $E_{BT}$, whichever is the lower value. The ATPV and $E_{BT}$ is determined pursuant to the testing methodology set forth in ASTM F1959 (*Standard Test Method for Determining the Arc Rating of Materials for Clothing,* 2014 edition, incorporated herein by reference), where sensors measure thermal energy properties of protective fabric specimens during exposure to a series of electric arcs.

NFPA 70E (*Standard for Electrical Safety in the Workplace,* 2021 edition, incorporated herein by reference) offers a method to match protective clothing to potential exposure levels incorporating Personal Protective Equipment (PPE) Categories. Protective fabrics are tested to determine their arc rating, and the measured arc rating determines the PPE Category for a fabric as follows:

PPE Category and ATPV

PPE Category 1: ATPV/$E_{BT}$: 4 cal/cm$^2$

PPE Category 2: ATPV/$E_{BT}$: 8 cal/cm$^2$

PPE Category 3: ATPV/$E_{BT}$: 25 cal/cm$^2$

PPE Category 4: ATPV/$E_{BT}$: 40 cal/cm$^2$

Thus, NFPA 70E dictates the level of protection a fabric must possess to be worn by workers in certain environments.

National Fire Protection Association (NFPA) 1971 (*Standard on Protective Ensembles for Structural Fire Fighting and Proximity Fire Fighting,* 2018 edition, incorporated herein by reference) governs the required performance of firefighter garments. NFPA 2112 (*Standard on Flame-Resistant Clothing for Protection of Industrial Personnel Against Flash Fire,* 2018 edition, incorporated herein by reference) governs the required performance of industrial worker garments that protect against flash fires. NFPA 1975 (*Standard on Emergency Services Work Apparel,* 2019 edition, incorporated herein by reference) governs the required performance of station wear worn by firefighter's in the firehouse and under turnout gear. These standards require that the garments and/or individual layers or parts thereof pass a number of different performance tests, including having a char length of 4 inches or less (NFPA 1971 and NFPA 2112) or 6 inches or less (ASTM F1506 and NFPA 1975) and of having a two second (or less) after flame, when measured pursuant to the testing methodology set forth in ASTM D6413 (*Standard Test Method for Flame Resistance of Textiles,* 2015 edition, incorporated herein by reference).

To test for char length and after flame, a fabric specimen is suspended vertically over a flame for twelve seconds. The fabric must self-extinguish within two seconds (i.e., it must have a 2 second or less after flame). After the fabric self-extinguishes, a specified amount of weight is attached to the fabric and the fabric lifted so that the weight is suspended from the fabric. The fabric will typically tear along the charred portion of the fabric. The length of the tear (i.e., the char length) must be 4 inches or less when the test is performed in both the machine/warp and cross-machine/weft directions of the fabric. A fabric sample is typically tested for compliance both before it has been washed (and thus when the fabric still contains residual—and often flammable—chemicals from finishing processes) and after a certain number of launderings (100 launderings for NFPA 2112, 25 launderings for ASTM F1506, and 5 launderings for NFPA 1971).

NFPA 1971, 2112, and 1975 also contain requirements relating to the extent to which the fabric shrinks when subjected to heat when tested pursuant to ASTM F2894-21 (*Standard Test Method for Evaluation of Materials, Protective Clothing, and Equipment for Heat Resistance Using a Hot Air Circulating Oven,* 2021 edition, incorporated herein by reference). To conduct thermal shrinkage testing on fabrics, marks are made on the fabric a distance from each other in both the machine/warp and cross-machine/weft directions. The distance between sets of marks is noted. The fabric is then suspended in a 500 degree Fahrenheit oven for 5 minutes. The distance between sets of marks is then re-measured. The thermal shrinkage of the fabric is then calculated as the percentage that the fabric shrinks in both the machine/warp and cross-machine/weft directions and must be less than the percentage set forth in the applicable standard. For example, NFPA 1971, 1975, and 2112 require that outer shell fabrics exhibit thermal shrinkage of no more than 10% in both the machine/warp and cross-machine/weft directions.

Stretchable yarns ("stretch yarns") made from elastic materials have been incorporated into protective fabrics to impart stretchability and flexibility to such fabrics. This, in turn, enhances the freedom of movement and comfort of the wearer of garments made from such fabrics. Elastic materials are typically characterized as having a high percentage of recovery after application of a biasing force (i.e., the material is able to return to its original dimension—or very close to it—after the biasing force is removed). One such methodology for testing the elasticity of a fabric and calculating the fabric's percent stretch and percent recovery generally involves the steps of (referred to as "Stretch/Recovery Test"):

1. Cut a sample of the fabric (e.g., 2" wide×14" long) and condition the sample fabric pursuant to ASTM D1776-20 (*Standard Practice For Conditioning And Testing Textiles,* 2020 edition, incorporated herein by reference).
2. Draw two lines across a width of the fabric and measure and record the distance between them. The lines preferably extend centered on the fabric sample approximately 10 inches apart.
3. Attach a weight clamp to the sample and then suspend the sample from the top of a testing frame such that the length of the fabric sample hangs downwardly.
4. Attach a 2.2 kilogram weight by hooking it through the center hole on the weight clamp. Lower the weight gently until it is entirely supported by the sample and start the timer.
5. After 30 seconds, measure and record the distance between the two lines.
6. Remove the weight and weight clamp and let the specimen relax for 60 seconds.
7. After 60 seconds, again measure and record the distance between the two lines. The percent stretch and percent recovery can be calculated as follows:

$$\text{percent stretch} = \frac{(A - I)}{I} * 100$$

$$\text{percent recovery} = 1 - \frac{(R - I)}{I} * 100$$

Initial length (I)

Displacement after 30 seconds under strain (A)

Displacement after 60 seconds of relaxation (R)

Prior art fabrics have incorporated stretchable yarns formed of spandex or rubber into flame resistant fabrics. However, such fabrics exhibit significant thermal shrinkage (typically greater than that permitted by applicable standards). Moreover, the elastic materials typically used to form the stretch yarns tend to degrade when subjected to repeated exposures to elevated temperatures, such as those associated with industrial laundering. Such degradation over time can detrimentally impact the elasticity of the materials (the ability of the yarns to stretch and recover). Still further, the stretchable fabric must be subjected to a finishing application whereby the fabric is exposed to high levels of heat to set the fabric to its final width and activate the stretch properties of the stretch yarns in the fabric. The high temperatures required to activate the stretch yarns made from elastic materials such as spandex and rubber (typically on the order of at least 380° F.) can degrade other protective fibers in the fabric (e.g., modacrylic fibers).

Thus, there is a need for flame resistant fabrics that incorporate stretch yarns into the fabric but that still are able to pass the requirements of at least one of NPFA 1971, 1975, and 2112 (including, but not limited to, meeting the thermal shrinkage requirements for garments made from such fabrics) and that can retain their stretch and recovery properties after repeated industrial launderings.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the present invention relate to flame resistant fabrics formed with a combination of body yarns and stretch yarns that exhibit excellent physical and thermal properties. The body yarns are formed at least in part with flame resistant materials. The stretch yarns are corespun yarns having an elastic core surrounded by a fiber sheath formed at least in part with flame resistant materials. The fiber sheath protects the elastic core from direct exposure to heat and flame that would otherwise cause the core to degrade or melt.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Some embodiments relate to flame resistant fabrics formed of a combination of body yarns and stretch yarns that exhibit excellent physical and thermal properties. In some embodiments, the flame resistant fabric has a warp direction and a fill direction. The flame resistant fabric includes a plurality of body yarns provided in both the warp direction and the fill direction of the fabric. The fabric can also include a plurality of stretch yarns extending between at least some of the body yarns in at least one (or both) of the warp direction or the fill direction of the fabric.

The body yarns can be spun, filament, or stretch broken yarns. In some embodiments, the body yarns are all spun yarns or are all filament yarns. However, the body yarns need not be all the same type of yarns. Rather, by way only of example, in some embodiments some of the body yarns in the fabric may be spun yarns while other body yarns in the same fabric may be filament yarns (oriented in the same and/or different fabric direction as the spun yarns).

Moreover, while the body yarns may be formed entirely of one type of fiber (e.g., 100 weight % aramid fibers), in some embodiments the body yarns are formed of a blend of fibers. Note that the fibers or blends thereof that form the body yarns in the fabric may not be identical in some embodiments. For example, in an embodiment where the body yarns include spun yarns each formed of a blend of fibers, the fiber blends of some of the spun yarns in the fabric may be different (between and/or within the warp and/or fill directions). This difference may result from the types of fibers used in the blends and/or the amounts of the same fiber types used in the blends.

The body yarns are formed (at least in part) of flame resistant ("FR") material(s). In some embodiments, the body yarns are formed with inherently FR staple fibers or staple fibers that have been treated to be flame resistant. In some embodiments, the body yarns include at least 40 weight % ("wt. %") flame resistant fibers, at least 45 wt. % flame resistant fibers, at least 50 wt. % flame resistant fibers, at least 55 wt. % flame resistant fibers, at least 60 wt. % flame resistant fibers, at least 65 wt. % flame resistant fibers, and/or at least 70 wt. % flame resistant fibers. In some embodiments non-FR fibers may be added to the fiber blends. In some embodiments, the body yarns include at least 25 wt. % non-FR fibers, at least 30 wt. % non-FR fibers, at least 35 wt. % non-FR fibers, at least 40 wt. % non-FR fibers, at least 45 wt. % non-FR fibers, at least 50 wt. % non-FR fibers, at least 55 wt. % non-FR fibers, and/or at least 60 wt. % non-FR fibers.

Exemplary FR and non-FR materials useful for forming the body yarns include, but are not limited to, aramids (including para-aramid and meta-aramid); polybenzimidazole ("PBI"); polybenzoxazole ("PBO"); modacrylic; poly{2,6-diimidazo[4,5-b:40;50-e]-pyridinylene-1,4(2,5-dihydroxy)phenylene} ("PIPD"); ultra-high molecular weight ("UHMW") polyethylene; UHMW polypropylene; polyvinyl alcohol; polyacrylonitrile; liquid crystal polymer; glass; nylon; carbon; silk; polyamide; polyester; and natural and synthetic cellulosics (e.g., cotton, rayon, acetate, triacetate, and lyocell fibers, as well as their flame resistant counterparts FR cotton, FR rayon, FR acetate, FR triacetate, and FR lyocell), TANLON™ fibers (available from Shanghai Tanlon Fiber Company), wool, melamine (such as BASOFIL™, available from Basofil Fibers), polyetherimide, polyethersulfone, pre-oxidized acrylic, polyamide-imide fibers such as KERMEL™, polytetrafluoroethylene, polyvinyl chloride, polyetheretherketone, polyetherimide fibers, polychlal, polyimide, polyimideamide, polyolefin, polyacrylate, and any combination or blend thereof.

Examples of para-aramid materials include KEVLAR™ (available from DuPont), TECHNORA™ (available from Teijin Twaron BV of Arnheim, Netherlands), and TWARON (also available from Teijin Twaron BV). Examples of meta-aramid materials include NOMEX™ (available from DuPont), CONEX™ (available from Teijin), and Kermel (available from Kermel). An example of a suitable modacrylic material is PROTEX™ available from Kaneka Corporation of Osaka, Japan. An example of a PIPD material includes M5 (Dupont). Examples of UHMW polyethylene materials include polymer material is VECTRAN (available from Kuraray). Examples of suitable rayon materials are Viscose™ and Modal™ by Lenzing, available from Lenzing Fibers Corporation. An example of an FR rayon material is Lenzing FR™, also available from Lenzing Fibers Corporation. Examples of lyocell material include TENCEL G 100™ and TENCEL AlOO™, both available from Lenzing Fibers Corporation.

In some embodiments, the flame resistant fibers in the body yarns include a blend of aramid fibers (meta-aramid, para-aramid, or both) and modacrylic fibers. The modacrylic fibers are significantly less expensive than the aramid fibers, thus helping to contain the cost of the fabric. In some embodiments the percentage of modacrylic fibers in the fiber blend of the body yarns is at least 2 times, at least 3 times, and/or at least 4 times the percentage of aramid fibers in the blend. In some embodiments, the body yarns include at least 30 wt. % modacrylic fibers, at least 35 wt. % modacrylic fibers, at least 40 wt. % modacrylic fibers, at least 45 wt. % modacrylic fibers, and/or at least 50 wt. % modacrylic fibers. In some embodiments, the body yarns include approximately: (i) 30-60 wt. % modacrylic fibers, inclusive; (ii) 35-55 wt. % modacrylic fibers, inclusive; (iii) 40-50 wt. % modacrylic fibers, inclusive; and/or (iv) 45-50 wt. % modacrylic fibers, inclusive. In some embodiments, the body yarns include at least 5 wt. % aramid fibers, at least 10 wt. % aramid fibers, at least 15 wt. % aramid fibers, at least 20 wt. % aramid fibers, at least 25 wt. % aramid fibers, and/or at least 30 wt. % aramid fibers. In some embodiments, the body yarns include approximately: (i) 5-30 wt. % aramid fibers, inclusive; (ii) 10-25 wt. % aramid fibers, inclusive; (iii) 10-20 wt. % aramid fibers, inclusive; (iv) 15-25 wt. % aramid fibers, inclusive; and/or (v) 15-20 wt. % aramid fibers, inclusive.

In some embodiments, cellulosic fibers may be added to the fiber blend of the body yarns to reduce cost and impart comfort. In some embodiments, the body yarns include at least 20 wt. % cellulosic fibers, at least 25 wt. % cellulosic fibers, at least 30 wt. % cellulosic fibers, at least 35 wt. % cellulosic fibers, at least 40 wt. % cellulosic fibers, at least 45 wt. % cellulosic fibers, and/or at least 50 wt. % cellulosic fibers. In some embodiments, the body yarns include approximately: (i) 20-50 wt. % cellulosic fibers, inclusive; (ii) 25-45 weight wt. % cellulosic fibers, inclusive; (iii) 30-40 wt. % cellulosic fibers, inclusive; (iv) 35-45 wt. % cellulosic fibers, inclusive; and/or (v) 35-40 wt. % cellulosic fibers, inclusive.

In some embodiments, the cellulosic fibers are lyocell fibers and/or non-FR lyocell fibers. In some embodiments, blends of different cellulosic fibers are used in the fiber blend of the body yarns. While the cellulosic fibers can be treated so as to be flame resistant, this is not necessary. Rather, inclusion of the inherently flame resistant fibers in the fiber blend imparts sufficient flame resistance and arc protection and prevents the cellulosic fibers from burning. For example, the modacrylic fibers control and counteract the flammability of the cellulosic fibers to prevent the cellulosic fibers from burning. In this way, the cellulosic fibers (or the yarns or fabrics made with such fibers) need not be treated with a FR compound or additive.

In some embodiments, the body yarns are formed from a blend of modacrylic, cellulosic (FR and/or non-FR), and aramid fibers, such as, but not limited to, approximately (i) 30-60 wt. % modacrylic fibers, 20-60 wt. % cellulosic fibers, and 5-30 wt. % aramid fibers; (ii) 40-55 wt. % modacrylic fibers, 30-45 wt. % cellulosic fibers, and 10-20 wt. % aramid fibers; (iii) 45-55 wt. % modacrylic fibers, 35-45 wt. % cellulosic fibers, and 10-20 wt. % aramid fibers; (iv) 40-50 wt. % modacrylic fibers, 30-40 wt. % cellulosic fibers, and 10-15 wt. % aramid fibers; and/or (v) 45-50 wt. % modacrylic fibers, 35-40 wt. % cellulosic fibers, and 15-20 wt. % aramid fibers. In some embodiments, the cellulosic fibers in the above blends are non-FR cellulosic fibers.

In some embodiments, additional fibers may be added to the fiber blend. These fibers, include, but are not limited to (1) anti-static fibers to dissipate or minimize static, (2) anti-microbial fibers, and/or (3) high tenacity fibers such as, but not limited to, nylon (i.e., polyamide) and/or polyester fibers to improve the wear property of the fabrics. In some embodiments, between 5-25 wt. % nylon fibers may be added to the blend.

The aramid fibers may be para-aramid fibers, meta-aramid fibers, or a blend of para-aramid and meta-aramid fibers. In some embodiments, the fiber blend includes additive-containing fibers, such as, but not limited to, those disclosed in U.S. Publication No. 2018/0171516 (incorporated herein by reference). For example, in some embodiments, the aramid fibers in the fiber blend may be producer-colored whereby the fibers are colored during the process of manufacturing the fibers themselves and not after fiber formation. In some embodiments, the aramid fibers are colored with a dark pigment (e.g., black or navy).

In some embodiments, the body yarns are formed from a blend of only modacrylic, cellulosic (FR and/or non-FR), and aramid fibers and are devoid of other types of fibers. In some embodiments, the body yarns are formed from a blend of only modacrylic, cellulosic (FR and/or non-FR), aramid fibers, and nylon fibers and are devoid of other types of fibers. In some embodiments, the body yarns are formed from a blend of only modacrylic, cellulosic (FR and/or non-FR), aramid fibers, nylon fibers, and anti-stat fibers and are devoid of other types of fibers.

Each end of the body yarns may be formed of a single body yarn or multiple body yarns may be plied or otherwise combined to form an end. In some embodiments, the body yarns have a singles equivalent cotton count range from 8 to 25.

In addition to the body yarns, stretch yarns are provided within the fabric. The stretch yarns can be any type of yarn, including, but not limited to, spun, filament, stretch broken, and corespun yarns. The stretch yarns can include any combination of FR/non-FR materials, as long as the overall fabric is flame resistant and/or satisfies the applicable or desired standards for flame resistant fabrics. Each end of the stretch yarns may be formed of a single yarn or multiple yarns may be combined, coupled, or covered (i.e., plied, ply twist, wrapped, coresheath, coverspun, etc.) to form an end. In some embodiments, the stretch yarns have a singles equivalent cotton count range from 8 to 25.

In some embodiments, the stretch yarns are a corespun yarn having an elastic core that is protected by a fiber sheath. In one specific, non-limiting example, the elastic core is a 100% cross-linked polyolefin elastic fiber core (such as that sold under the tradename XLA (https://www.xlancefibre-.com)) about which a plurality of individual staple fibers are spun to form a fiber sheath that surrounds the core. By way of example, the staple fibers can be spun around the core using a dref spin procedure or air jet spinning process.

The fiber sheath protects the elastic core from direct exposure to heat and flame that would otherwise cause the core to degrade or melt. The fiber sheath preferably includes flame resistant fibers such that the resultant fabric provides a desired level of flame/thermal resistance protection and is stretchable in at least one direction (the direction in which the stretch yarns are provided) without risking a loss of such flame resistance protection. Materials useful in the fiber sheath include, but are not limited to, the same fibers identified above for use in the body yarns. In some embodiments, the sheath surrounding the core has substantially the same or similar fiber blend as some or all of the body yarns, but such is not a requirement.

XLA fibers can be activated at much lower temperatures than traditional stretch materials, such as at 200° F. to 220° F. Thus, the temperatures required to finish a fabric that includes such elastic fibers are much lower than those required to finish traditional stretch fabrics and thus less likely to damage or degrade other fibers in the fabric.

The body yarns and stretch yarns can subsequently be used to form flame resistant fabrics in a variety of ways, all well known in the industry. Any desirable weave (e.g., plain, twill, rip-stop, basketweave) or knit (e.g., single, double, plain, interlock) pattern may be used. In one embodiment, the fabric is formed as a plain weave fabric.

The flame resistant fabrics contemplated herein may include the body yarns and the stretch yarns in any combination or orientation. For example, in some embodiments the fabric may be a woven fabric that includes a warp direction and a fill direction. The body yarns will typically be provided in both the warp and fill directions. The stretch yarns may be included in only the warp direction, in only the fill direction, or in both the warp and fill direction so as to form a grid pattern within the fabric. In one non-limiting embodiment, the stretch yarns are provided only in the fill direction such that both body yarns and fill yarns extend in the fill direction and only body yarns extend in the warp direction.

The stretch yarns may be located in the fabric relative to the body yarns in any desired ratio. The ratio of stretch yarns to body yarns may be the same or different (1) within a direction of the fabric and/or (2) in different directions of the fabric. The ratio is calculated by counting the yarn ends. For example, when considering a plied yarn, each yarn in the ply is not considered individually for purposes of determining the ratio, but rather the plied yarns together are considered as a single end. For example, consider a fabric woven in a pattern with the following yarn repeat: two 2-ply first yarns (i.e., each first yarn is formed by plying two individual yarns) followed by one singles second yarn (i.e., the second yarn is unplied). The ratio of second yarns to first yarns for such a fabric is 1:2 based on each yarn end.

The ratio of stretch yarns to body yarns in either or both of the warp and/or fill direction of the fabric can be from about 40:1 to about 1:40, or from about 30:1 to about 1:30, or from about 25:1 to about 1:25, or from about 20:1 to about 1:20, or from about 15:1 to about 1:15, or from about 10:1 to about 1:10, or 9:1, or 8:1, or 7:1, or 6:1, or 5:1, or 4:1, or 3:1, or 2:1, or 1:1, or 1:2, or 1:3, or 1:4, or 1:5, or 1:6, or 1:7, or 1:8, or 1:9, or even from about 2:3 or 3:2 to about 1:3, or any combination of these ratios within the weave or knit pattern. In certain embodiments, typically equal or more body yarns than stretch yarns will be provided in a fabric direction such that the ratio of stretch yarns to body yarns in that direction will be in a range from about 1:1 to about 1:10 or any intermediate ratio in that range. In certain embodiments, the ratio of stretch yarns to body yarns in a fabric direction (e.g., the fill direction) is from 1:1 to 1:5, such as 1:2, 1:3, 1:4, or 1:5. In some embodiments, the ratio of stretch yarns to body yarns within a fabric direction can vary. By way only of example, a first ratio of stretch yarns to body yarns in a fabric direction can be 1:2 followed by a second ratio of stretch yarns to body yarns in that fabric direction of 1:3. In this way, the fabric in that direction would have a repeating sequence of one stretch yarn, followed by two body yarns, followed by one stretch yarn, followed by three body yarns. Any combination of any number of different ratios may be used within a fabric direction.

In some embodiments, the fabrics disclosed herein have a weight between 3-14 ounces per square yard ("osy"), inclusive; 4-12 osy, inclusive; 5-9 osy, inclusive; 6-8.5 osy, inclusive; 7-10 osy, inclusive; 7-9 osy, inclusive; 8-12 osy, inclusive; 4-8 osy, inclusive; 4-7.5 osy, inclusive; 4-7 osy, inclusive; 5-7 osy, inclusive; 5.5-7 osy, inclusive; or 6-7 osy, inclusive. In some embodiments, the fabric weight is 6-9 osy, inclusive, and/or is less than or equal to 9 osy, 8 osy, 7 osy and/or less than or equal to 6 osy.

The flame resistant fabrics contemplated herein are constructed with a balance of body yarns and stretch yarns such that the resulting fabric (i) complies with the requirements of at least one of NFPA 1971, 1975 and 2112 (including having acceptable arc ratings and low thermal shrinkage), (ii) exhibits good dimensional stability when subjected to repeated launderings, and (iii) possesses good stretch and recovery properties, even after laundering.

By way only of example, embodiments of stretch fabrics contemplated herein (1) comply with the vertical flammability requirements of ASTM F1506 (char length of 6 inches or less and a two second or less afterflame) and/or NFPA 1971 and 2112 (char length of 4 inches or less and a two second or less afterflame); (2) achieve an arc rating of at least 4 cal/cm$^2$, or of at least 8 cal/cm$^2$, when tested pursuant to ASTM F1959; and (3) exhibit thermal shrinkage of no more than 10% in both the machine/warp and cross-machine/weft directions when tested pursuant to ASTM F2894-21. Furthermore, embodiments of stretch fabrics contemplated herein achieve a percent stretch of at least 10%, and preferably at least 15-20%, and a percent recovery of at least 75% and more preferably at least 80%, at least 85%, at least 90%, at least 95%, at least 96%, at least 97%, at least 98%, or at least 99% in each fabric direction in which stretch yarns are incorporated, when tested pursuant to the Stretch/Recovery Test described above. Some embodiments are able to achieve these percent stretch and/or percent recovery numbers after 25-150 industrial launderings ("IL"), 50-125 industrial launderings, and 75-100 industrial launderings, when washed pursuant to the methodology described below. Some embodiments of the stretch fabrics contemplated herein achieve a percent stretch of at least 10% (and preferably at least 15-20%) and a percent recovery of at least 75% and more preferably at least 80%, at least 85%, at least 90%, at least 95%, at least 96%, at least 97%, at least 98%, or at least 99% after 100 industrial launderings.

Specific, non-limiting embodiments of stretch fabrics are as follows:

Inventive Fabric 1: An 7.9 osy woven fabric formed with warp yarns and fill yarns. All of the warp yarns were 13/1 cc spun yarns having a fiber blend of 47 wt. % modacrylic/37 wt. % non-FR cellulosic/16 wt. % black producer-colored aramid. Two different fill yarns were used. Fill yarns #1 were each a 10/1 cc stretch corespun yarn having a XLA elastic fiber core and a fiber sheath of the same fiber blend as that of the warp yarns. Fill yarns #2 were each a 20/2 cc plied spun yarn of the same fiber blend as that of the warp yarns. Fill yarns #1 and fill yarns #2 were provided in the fill direction in a ratio of 1:2, meaning that each end of fill yarn #1 (the stretch yarn) was followed by two ends of fill yarns #2 (each a plied spun yarn) in a repeating pattern across the fill direction.

Inventive Fabric 2: An 8.4 osy woven fabric formed with warp yarns and fill yarns. All of the warp yarns were 20/2 cc spun yarns having a fiber blend of 47 wt. % modacrylic/37 wt. % non-FR cellulosic/16 wt. % black producer-colored aramid. Two different fill yarns were used. Fill yarns #1 were each a 10/1 cc stretch corespun yarn having a XLA elastic fiber core and a fiber sheath of the same fiber blend as that of the warp yarns. Fill yarns #2 were each a 20/2 cc plied spun yarn of the same fiber blend as that of the warp yarns. Fill yarns #1 and fill yarns #2 were provided in the fill direction in a ratio of 1:2, meaning that each end of fill yarn #1 (the stretch yarn) was followed by two ends of fill yarns #2 (each a plied spun yarn) in a repeating pattern across the fill direction.

Inventive Fabrics 1 and 2 were piece-dyed and tenter-finished. Inventive Fabric 2 was subjected to a standard 140° Fahrenheit industrial wash for 30 minutes. After wash, the fabric was dried for 30 minutes in an industrial dryer with a stack temperature not exceeding 155° Fahrenheit. This wash and dry process is collectively referred to as an industrial laundering or "IL".

The physical and thermal properties of Inventive Fabric 1 and Inventive Fabric 2 were tested, and the results are set forth in Table 1:

TABLE 1

| Tested Property | Inventive Fabric 1 | Inventive Fabric 2 | Test Method |
|---|---|---|---|
| Weight (osy) | 7.9 | 8.4 | ASTM D 3776 |
| Char Length (before wash or "BW") (w × f, inches) | 2.7 × 2.6 | 2 × 2.2 | ASTM D 6413 |
| After Flame (BW) (w × f, sec) | 0 × 0 | 0 × 0 | ASTM D 6413 |
| Thermal shrinkage (BW) (w × f, %) | −3.1 × −6.6 | −5.2 × -5.8 | ASTM F 2894-21 |
| % Stretch in Fill Direction (BW) (%) | 17.1 | 13.8 | Stretch/Recovery Test |
| % Recovery in Fill Direction (BW) (%) | 96.5 | 99.4 | Stretch/Recovery Test |
| % Stretch in Fill Direction (after wash 20 × IL) (%) | — | 12.7 | Stretch/Recovery Test |
| % Recovery in Fill Direction (after wash 20 × IL) (%) | — | 97.9 | Stretch/Recovery Test |
| % Stretch in Fill Direction (after wash 92 × IL) (%) | — | 15.6 | Stretch/Recovery Test |
| % Recovery in Fill Direction (after wash 92 × IL) (%) | — | 97.2 | Stretch/Recovery Test |
| Arc Rating (cal/cm$^2$) | — | 12.3 | ASTM 1959 |
| Manikin Burn (%) | — | 13.1 | NFPA 2112 |

In some embodiments, the % stretch in a fabric direction in which stretch yarns are incorporated (when tested pursuant to the Stretch/Recovery Test described above) after 100 industrial launderings is no more than 5% less than the % stretch in that fabric direction prior to industrial laundering (i.e., BW). In some embodiments, the % recovery in a fabric direction in which stretch yarns are incorporated (when tested pursuant to the Stretch/Recovery Test described above) after 100 industrial launderings is no more than 5% less than the % recovery in that fabric direction prior to industrial laundering (i.e., BW). Thus and by way only of example, if the % recovery in a fabric direction with stretch yarns is 98% BW, then the % recovery in that fabric direction after 100 ILs should be no less than 93%.

Embodiments of the fabric disclosed herein may be used in the construction of a variety of protective garments, either by itself or in combination with other fabrics, and is not limited for use solely in the applications disclosed herein.

EXAMPLES

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A flame resistant fabric having a warp direction and a fill direction, the fabric comprising a plurality of body yarns each formed of a body yarn fiber blend and provided in both the warp direction and the fill direction of the fabric, wherein the body yarn fiber blend comprises modacrylic fibers, cellulosic fibers, and aramid fibers; and a plurality of stretch yarns extending between at least some of the body yarns in at least one of the warp direction or the fill direction of the fabric, wherein each stretch yarn comprises an elastic core surround by a sheath, wherein the sheath comprises a sheath fiber blend comprising modacrylic fibers, cellulosic fibers, and aramid fibers, wherein the fabric has a char length of 6 inches or less and an afterflame of 2 seconds or less when tested pursuant to ASTM D6413 (2015); the fabric has an arc rating of at least 8 cal/cm$^2$ when tested pursuant to ASTM F1959 (2014); the fabric exhibits thermal shrinkage of no more than 10% in both the warp and fill directions when tested pursuant to ASTM F 2894 (2021); and the fabric comprises a percent stretch and a percent recovery in the at least one of the warp direction or the fill direction in which the plurality of stretch yarns extend, wherein the percent stretch is at least 10% and the percent recovery is at least 90% after 100 industrial launderings, whereby in each industrial laundering the fabric is subjected to a standard 140° Fahrenheit industrial wash for 30 minutes and the fabric is dried for 30 minutes in an industrial dryer with a stack temperature not exceeding 155° Fahrenheit.

Example 2. The fabric of any of the preceding or subsequent examples or combination of examples, wherein the body yarn fiber blend comprises 40-55 wt. % modacrylic fibers, 30-45 wt. % non-FR cellulosic fibers, and 10-20 wt. % aramid fibers.

Example 3. The fabric of any of the preceding or subsequent examples or combination of examples, wherein the sheath fiber blend comprises 40-55 wt. % modacrylic fibers, 30-45 wt. % non-FR cellulosic fibers, and 10-20 wt. % aramid fibers.

Example 4. The fabric of any of the preceding or subsequent examples or combination of examples, wherein the body yarn fiber blend and the sheath fiber blend are substantially identical.

Example 5. The fabric of any of the preceding or subsequent examples or combination of examples, wherein the body yarn fiber blend and the sheath fiber blend each comprises 40-55 wt. % modacrylic fibers, 30-45 wt. % non-FR cellulosic fibers, and 10-20 wt. % aramid fibers.

Example 6. The fabric of any of the preceding or subsequent examples or combination of examples, wherein the body yarn fiber blend comprises only modacrylic fibers, cellulosic fibers, and aramid fibers.

Example 7. The fabric of any of the preceding or subsequent examples or combination of examples, wherein the elastic core comprises polyolefin.

Example 8. The fabric of any of the preceding or subsequent examples or combination of examples, wherein the plurality of stretch yarns are provided in only one of the warp direction and the fill direction.

Example 9. The fabric of any of the preceding or subsequent examples or combination of examples, wherein the plurality of stretch yarns are provided in only the fill direction.

Example 10. The fabric of any of the preceding or subsequent examples or combination of examples, wherein the plurality of stretch yarns are provided in the at least one of the warp direction or the fill direction of the fabric in a stretch yarn to body yarn ratio from about 1:2 to about 1:10.

Example 11. The fabric of any of the preceding or subsequent examples or combination of examples, wherein the plurality of stretch yarns are provided in the at least one of the warp direction or the fill direction of the fabric in a stretch yarn to body yarn ratio from about 1:2 to about 1:5.

Example 12. The fabric of any of the preceding or subsequent examples or combination of examples, wherein the plurality of stretch yarns are provided in the at least one of the warp direction or the fill direction of the fabric in a stretch yarn to body yarn ratio of 1:2.

Example 13. The fabric of any of the preceding or subsequent examples or combination of examples, wherein the fabric comprises a weight between 7-9 ounces per square yard, inclusive.

Example 14. The fabric of any of the preceding or subsequent examples or combination of examples, wherein the body yarns are spun yarns.

Example 15. The fabric of any of the preceding or subsequent examples or combination of examples, wherein the aramid fibers are producer-colored fibers and contain a dark pigment.

Example 16. The fabric of any of the preceding or subsequent examples or combination of examples, wherein at least some of the body yarns are plied.

Example 17. The fabric of any of the preceding or subsequent examples or combination of examples, wherein the percent recovery is at least 95%.

Example 18. The fabric of any of the preceding or subsequent examples or combination of examples, wherein the percent stretch and the percent recovery after 100 industrial launderings is no more than 5% less than the percent stretch and the percent recovery prior to a first of the 100 industrial launderings.

Example 19. A flame resistant fabric having a warp direction and a fill direction, the fabric comprising: a plurality of body yarns each formed of a body yarn fiber blend and provided in both the warp direction and the fill direction of the fabric, wherein the body yarn fiber blend comprises modacrylic fibers, cellulosic fibers, and aramid fibers; a plurality of stretch yarns extending between at least some of the body yarns in at least one of the warp direction or the fill direction of the fabric, wherein each stretch yarn comprises an elastic core surround by a sheath, wherein the sheath comprises a sheath fiber blend comprising modacrylic fibers, cellulosic fibers, and aramid fibers, wherein: the body yarn fiber blend and the sheath fiber blend each comprises 40-55 wt. % modacrylic fibers, 30-45 wt. % non-FR cellulosic fibers, and 10-20 wt. % aramid fibers; the body yarn fiber blend and the sheath fiber blend are substantially identical;

the plurality of stretch yarns are provided in the at least one of the warp direction or the fill direction of the fabric in a stretch yarn to body yarn ratio from about 1:2 to about 1:4; the fabric has a char length of 6 inches or less and an afterflame of 2 seconds or less when tested pursuant to ASTM D6413 (2015); the fabric has an arc rating of at least 8 cal/cm$^2$ when tested pursuant to ASTM F1959 (2014); the fabric exhibits thermal shrinkage of no more than 10% in both the warp and fill directions when tested pursuant to ASTM F 2894 (2021); the fabric comprises a weight between 7 to 10 ounces per square yard, inclusive; and the fabric comprises a percent stretch and a percent recovery in the at least one of the warp direction or the fill direction in which the plurality of stretch yarns extend, wherein the percent stretch is at least 10% and the percent recovery is at least 95% after 100 industrial launderings, whereby in each industrial laundering the fabric is subjected to a standard 140° Fahrenheit industrial wash for 30 minutes and the fabric is dried for 30 minutes in an industrial dryer with a stack temperature not exceeding 155° Fahrenheit.

Example 20. The fabric of any of the preceding or subsequent examples or combination of examples, wherein the plurality of stretch yarns are provided in only the fill direction.

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A flame resistant fabric having a warp direction and a fill direction, the fabric comprising:

a plurality of spun body yarns provided in both the warp direction and the fill direction, wherein each of the plurality of spun body yarns formed of are spun from a body yarn fiber blend comprising modacrylic fibers, cellulosic fibers, and aramid fibers; and a plurality of stretch yarns extending between at least some of the spun body yarns in at least one of the warp direction or the fill direction of the fabric, wherein each stretch yarn comprises an elastic core surround by a sheath, wherein the sheath comprises a sheath fiber blend comprising modacrylic fibers, cellulosic fibers, and aramid fibers, wherein:

i. the fabric has a char length of 6 inches or less and an afterflame of 2 seconds or less when tested pursuant to ASTM D6413 (2015);

ii. the fabric has an arc rating of at least 8 cal/cm$^2$ when tested pursuant to ASTM F1959 (2014);

iii. the fabric exhibits thermal shrinkage of no more than 10% in both the warp and fill directions when tested pursuant to ASTM F 2894 (2021); and iv. the fabric comprises a percent stretch and a percent recovery in the at least one of the warp direction or the fill direction in which the plurality of stretch yarns extend, wherein the percent stretch is at least 10% and the percent recovery is at least 90% after 100 industrial launderings, whereby in each industrial laundering the fabric is subjected to a standard 140° Fahrenheit industrial wash for 30 minutes and the fabric is dried for 30 minutes in an industrial dryer with a stack temperature not exceeding 155° Fahrenheit.

2. The flame resistant fabric of claim 1, wherein the cellulosic fibers of the body yarn fiber blend are non-FR cellulosic fibers, and wherein the body yarn fiber blend comprises 40-55 wt. % modacrylic fibers, 30-45 wt. % non-FR cellulosic fibers, and 10-20 wt. % aramid fibers.

3. The flame resistant fabric of claim 1, wherein the cellulosic fibers of the sheath fiber blend are non-FR cellulosic fibers, and wherein the sheath fiber blend comprises 40-55 wt. % modacrylic fibers, 30-45 wt. % non-FR cellulosic fibers, and 10-20 wt. % aramid fibers.

4. The flame resistant fabric of claim 1, wherein the body yarn fiber blend and the sheath fiber blend are substantially identical.

5. The flame resistant fabric of claim 4, wherein the cellulosic fibers of the body yarn fiber blend and the sheath fiber blend are non-FR cellulosic fibers, and wherein the body yarn fiber blend and the sheath fiber blend each comprises 40-55 wt. % modacrylic fibers, 30-45 wt. % non-FR cellulosic fibers, and 10-20 wt. % aramid fibers.

6. The flame resistant fabric of claim 1, wherein the body yarn fiber blend comprises only modacrylic fibers, cellulosic fibers, and aramid fibers.

7. The flame resistant fabric of claim 1, wherein the elastic core comprises polyolefin.

8. The flame resistant fabric of claim 1, wherein the plurality of stretch yarns are provided in only one of the warp direction and the fill direction.

9. The flame resistant fabric of claim 8, wherein the plurality of stretch yarns are provided in only the fill direction.

10. The flame resistant fabric of claim 1, wherein the plurality of stretch yarns are provided in the at least one of the warp direction or the fill direction of the fabric in a stretch yarn to spun body yarn ratio from about 1:2 to about 1:10.

11. The flame resistant fabric of claim 10, wherein the plurality of stretch yarns are provided in the at least one of the warp direction or the fill direction of the fabric in a stretch yarn to spun body yarn ratio from about 1:2 to about 1:5.

12. The flame resistant fabric of claim 11, wherein the plurality of stretch yarns are provided in the at least one of the warp direction or the fill direction of the fabric in a stretch yarn to spun body yarn ratio of 1:2.

13. The flame resistant fabric of claim 1, wherein the fabric comprises a weight between 7-9 ounces per square yard, inclusive.

14. The flame resistant fabric of claim 1, wherein the aramid fibers are producer-colored fibers and contain a dark pigment.

15. The flame resistant fabric of claim 1, wherein at least some of the spun body yarns are plied.

16. The flame resistant fabric of claim 1, wherein the percent recovery is at least 95%.

17. The flame resistant fabric of claim 1, wherein the percent stretch and the percent recovery after 100 industrial launderings is no more than 5% less than the percent stretch and the percent recovery prior to a first of the 100 industrial launderings.

18. A flame resistant fabric having a warp direction and a fill direction, the fabric comprising:

(a) a plurality of spun body yarns provided in both the warp direction and the fill direction, wherein each of the plurality of spun body yarns are spun from a body yarn fiber blend comprising modacrylic fibers, non-FR cellulosic fibers, and aramid fibers;

a plurality of stretch yarns extending between at least some of the spun body yarns in at least one of the warp direction or the fill direction of the fabric, wherein each stretch yarn comprises an elastic core surround by a sheath, wherein the sheath comprises a sheath fiber blend comprising modacrylic fibers, cellulosic fibers, and aramid fibers, wherein:

i. the body yarn fiber blend and the sheath fiber blend each comprises 40-55 wt. % modacrylic fibers, 30-45 wt. % non-FR cellulosic fibers, and 10-20 wt. % aramid fibers;

ii. the body yarn fiber blend and the sheath fiber blend are substantially identical;

iii. the plurality of stretch yarns are provided in the at least one of the warp direction or the fill direction of the fabric in a stretch yarn to spun body yarn ratio from about 1:2 to about 1:4;

iv. the fabric has a char length of 6 inches or less and an afterflame of 2 seconds or less when tested pursuant to ASTM D6413 (2015);

V. the fabric has an arc rating of at least 8 cal/cm$^2$ when tested pursuant to ASTM F1959 (2014);

vi. the fabric exhibits thermal shrinkage of no more than 10% in both the warp and fill directions when tested pursuant to ASTM F 2894 (2021);

vii. the fabric comprises a weight between 7 to 10 ounces per square yard, inclusive; and viii. the fabric comprises a percent stretch and a percent recovery in the at least one of the warp direction or the fill direction in which the plurality of stretch yarns extend, wherein the percent stretch is at least 10% and the percent recovery is at least 95% after 100 industrial launderings, whereby in each industrial laundering the fabric is subjected to a standard 140° Fahrenheit industrial wash for 30 minutes and the fabric is dried for 30 minutes in an industrial dryer with a stack temperature not exceeding 155° Fahrenheit.

19. The flame resistant fabric of claim 18, wherein the plurality of stretch yarns are provided in only the fill direction.

20. The flame resistant fabric of claim 1, wherein the plurality of stretch yarns are provided in the fill direction of the fabric in a stretch yarn to spun body yarn ratio from about 1:2 to about 1:10, and wherein the warp direction is devoid of the stretch yarns.

* * * * *